United States Patent [19]

McMahon et al.

[11] Patent Number: 4,493,566

[45] Date of Patent: Jan. 15, 1985

[54] FRONT TO BACK ADJUSTMENT FOR CARRIAGE ASSEMBLY

[75] Inventors: Ronald G. McMahon; Donnie E. Hale, both of Garland, Tex.

[73] Assignee: Contitronix, Inc., Garland, Tex.

[21] Appl. No.: 387,156

[22] Filed: Jun. 10, 1982

[51] Int. Cl.[3] ..... B41J 11/20

[52] U.S. Cl. ..... 400/59; 400/55; 400/354.3; 400/355; 400/653

[58] Field of Search ..... 400/55, 57, 58, 59, 400/648, 649, 653, 56, 352, 353, 354.3, 355, 356

[56] References Cited

U.S. PATENT DOCUMENTS

| | | | |
|---|---|---|---|
| 524,185 | 8/1894 | Sholes | 400/354.3 |
| 4,086,997 | 5/1978 | Wu | 400/57 |
| 4,268,177 | 5/1981 | Veale | 400/59 X |
| 4,300,847 | 11/1981 | Hoffman et al. | 400/59 |
| 4,381,896 | 5/1983 | Shiurila | 400/56 |

FOREIGN PATENT DOCUMENTS

| | | | |
|---|---|---|---|
| 55-158990 | 12/1980 | Japan | 400/58 |

OTHER PUBLICATIONS

*IBM Technical Disclosure Bulletin;* R. E. Hunt; "Constant Free-Flight Adjustable Platen for Impact Platen"; vol. 14, No. 7; pp. 2193-2194; Dec. 1971.

*Primary Examiner*—Edgar S. Burr
*Assistant Examiner*—David A. Wiecking
*Attorney, Agent, or Firm*—Sigalos & Levine

[57] ABSTRACT

Apparatus for adjusting the relative position of a carriage assembly to a platen on a printer frame comprising first and second parallel supports mounted to a printer frame in spaced apart relationship parallel to said platen, a pulley support assembly mounted on one of the supports for movement parallel to said one support, a bearing assembly slidably mounted on the other of the supports, a carriage assembly detachably mounted to said pulley support assembly and slidably attached to the bearing assembly to allow movement of the carriage assembly towards or away from the bearing assembly while maintaining contact with the bearing, and means for adjusting the one support in a horizontal plane towards or away from the platen whereby the carriage assembly is moved toward or away from the platen.

1 Claim, 3 Drawing Figures

FRONT TO BACK ADJUSTMENT FOR CARRIAGE ASSEMBLY

BACKGROUND OF THE PRESENT INVENTION

The present invention relates to a printing mechanism such as a carriage assembly and in particular to a carriage assembly for a typewriter or any other type of impact printer wherein the spacing between the printing element on the carriage assembly and the platen must be adjusted.

Prior art printing units which are of the impact type require periodic adjustment of the space between the platen which holds the paper and the printing element itself. This is accomplished in the prior art by mounting the cylindrical platen in the printer frame such that the cylindrical platen can be adjusted in both the vertical and horizontal planes. This requires, of course, at least two overlapping plates on the printer frame in which the platen is mounted and in which the platen may be adjusted by moving one of the plates in the horizontal or vertical plane and then after it is properly adjusted in that plane that plate is locked so that no further movement can take place in that plane and then the second plate is adjusted which allows movement of the platen in the second of the two planes until the proper spacing adjustment is obtained and then that plate is locked. As can be expected, such mechanism is rather complex and, in addition, is difficult to adjust in one plane without affecting the adjustment in the other plane. Great care must be taken so that this interference does not occur.

The present invention overcomes the disadvantages of the prior art by allowing the platen to be adjusted in only the vertical plane and thus the relative horizontal position of the printing mechanism and the platen with respect to each other is adjusted by moving the printing mechanism with respect to the platen in a horizontal plane. In the present case, the printing mechanism is mounted on a pulley support assembly which, in turn, is mounted on a cylindrical support or shaft which is attached to the printer frame parallel to the axis of the platen whereby if the cylindrical support or shaft is moved in a horizontal plane towards or away from said cylindrical platen, the horizontal space between the printing mechanism carried by the pulley support assembly and the cylindrical platen is adjusted. Therefore, horizontal adjustment of the support or shaft which carries the pulley support assembly and the carriage assembly with the printing mechanism thereon has no effect on the physical position of the cylindrical platen and there is no interaction between the two other than the space therebetween being adjusted. In like manner, if the cylindrical platen is adjusted in the vertical plane, it has no interaction with the adjustment of the support member on which the printing mechanism is being carried by the pulley support assembly. Therefore, the problems of the prior art are obviated by the present invention in a manner which is simple and yet effective.

SUMMARY OF THE INVENTION

Thus, the present invention relates to apparatus for adjusting the relative position of a print mechanism on a printer frame in vertical and horizontal planes with respect to a platen comprising means for adjusting the position of the platen in one of the planes with respect to the print mechanism and means for adjusting the position of the print mechanism in the other plane with respect to the platen whereby the physical adjustment in one plane has no effect on the physical adjustment in the other plane.

BRIEF DESCRIPTION OF THE DRAWINGS

These and other objects and advantages of the present invention will be disclosed in the course of the following specification, reference being had to the accompanying drawings, in which.

DETAILED DESCRIPTION OF THE PREFERRED EMBODIMENT

Figure 1:
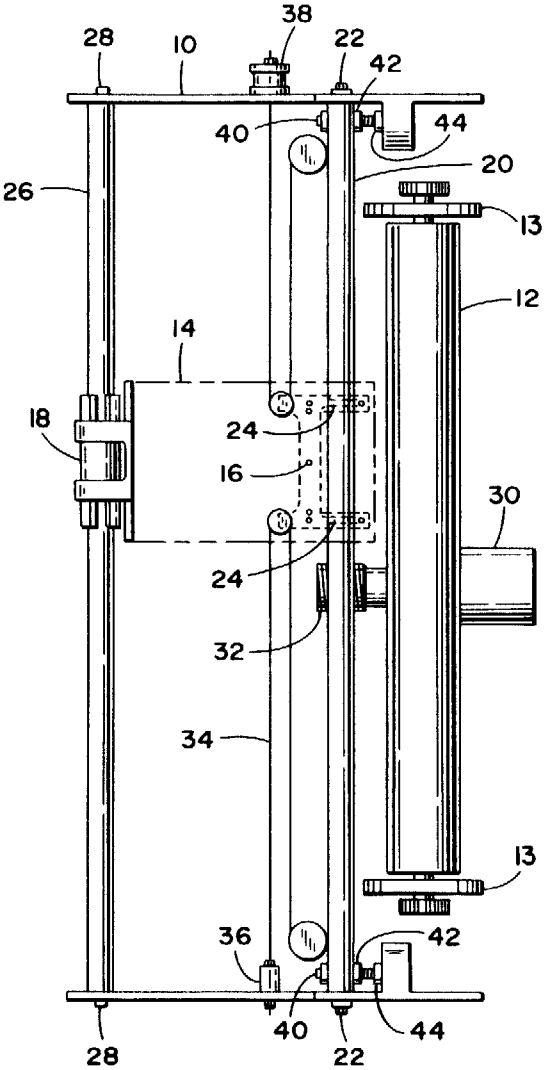
FIG. 1 is a schematic representation of a printer frame such as a typewriter illustrating the relative position of the cylindrical platen and the print mechanism and the manner in which the print mechanism may be adjusted in a horizontal plane in a position with respect to the cylindrical platen.

In order to clearly understand the relationship of the present invention to a print mechanism, the device will be shown in relation to a typewriter and a cylindrical platen although the invention would work as well with other types of printers and other types of platens whose position must be adjusted relative to each other. As can be seen in FIG. 1, a printer frame 10 has a cylindrical platen 12 mounted thereon in any well known manner, not shown. In addition, a carriage assembly 14 having a printing element or mechanism thereon and shown in dashed lines for illustrative purposes only, is mounted on a pulley support assembly 16 and a rear support bearing 18. A first support 20 in the form of a cylindrical elongated shaft which is mounted to frame 10 by means of bolts 22 carries the pulley support mechanism 16 by means of a bearing assembly 24. The rear bearing assembly 18 rides on a second or rear support shaft 26 which is also in the shape of an elongated cylinder parallel to the first support 20 and which also is rigidly attached to frame 10 by means of bolts 28. The carriage assembly 14 is detachably mounted to pulley support assembly 16 and slidably mounted on bearing support 18 which allows carriage assembly 14 to move horizontally with respect to bearing assembly 18. The construction of this bearing and the slidable relationship thereto by carriage assembly 14 is more fully described in commonly assigned co-pending patent application serial number 386,717 filed June 9, 1982 now U.S. Pat. No. 4,468,144 issued 8/28/84 and entitled Detachable Carriage Assembly For Printer. Further, a motor 30 drives a cable drum 32 to which cable 34 is attached. One end of cable 34 is rigidly attached to the frame 10 by any well known means 36 and is attached at the other end to an adjusting mechanism 38 which keeps the tension on cable 34 properly adjusted. Thus when motor 30 is activated and drum 32 rotates, pulley support assembly 16 moves in a horizontal direction parallel to platen 12 depending upon which way motor 30 is turning. Since the carriage assembly 14 with the printing mechanism (not shown) is attached to pulley support assembly 16, the carriage assembly 14, and thus the printing mechanism is caused to move in a direction parallel to platen 12 so that printing can occur on the paper which is carried by platen 12.

As is well known in the prior art, if it is necessary to adjust the relative position of platen 12 with respect to the printing mechanism on carriage assembly 14, the relative position of platen 12 was adjusted in both horizontal and vertical planes with respect to carriage assembly 14. This required a complex adjustment mechanism and a mechanism in which the adjustment in one plane conceivably affected the adjustment in the other. To prevent such cross coupling required a very complex mounting arrangement for platen 12 including at least two independently adjustable plates mounted on the printer frame, one for vertical adjustment and one for horizontal adjustment. However, the horizontal relationship of platen 12 to the printing mechanism on carriage assembly 14 is adjusted in the present invention by adjusting the relative position of carriage assembly 14 with respect to platen 12. Because carriage assembly 14 is mounted on pulley support assembly 16 which is attached by bearing supports 24 to front support 20, and slidably mounted to bearing 18 on rear support 26, one need only adjust the position of front support 20 in a horizontal plane relative to platen 12 and the print mechanism on carriage assembly 14 will move towards or away from platen 12 simply by following the position of support 20 and sliding on bearing 18 on rear support 26. This is accomplished as shown in FIG. 1 by means of bolts 40 near the ends of front support 20 and which pass through the support 20 in a direction perpendicular to the longitudinal axis thereof. Bolts 40 enter threaded orifices (not shown) in frame 10 and have nuts 42 and 44 thereon which, when tightened, hold the support 20 rigidly in place with respect to the platen 12. However, when nuts 42 and 44 are loosened and when bolts 22 are loosened, then by adjusting bolt 40, front support 20 is caused to move towards or away from platen 12 depending upon the direction in which bolt 40 is turned. When the correct relative position of the printing element on carriage assembly 14 and platen 12 is attained by turning bolts 40, nuts 42 and 44 are tightened and end bolts 22 are tightened and front support 20 is securely locked in place with respect to platen 12. Thus the adjustment has been made of the printing mechanism on carriage assembly 14 with respect to platen 12 in a horiztonal plane and the adjustment is a simple one which does not require any exceptional training of the individual performing the adjustment or any disassembling of the printer.

Figure 2:
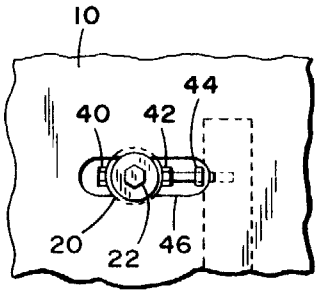
FIG. 2 is an end view of the printer frame illustrating the manner in which the print mechanism support or shaft is mounted to the frame and may be adjusted in a horizontal position thus adjusting the horizontal position of the printer with respect to the platen.

FIG. 2 is a partial end view of the printer shown in FIG. 1 illustrating the manner in which the front support 20 is attached to the frame. Thus, as can be seen in FIG. 2, a slot 46 is formed in printer frame 10. Bolt 22 passes through the slot and engages a threaded orifice in support 20 and by tightening bolt 22 the support 20 can be pulled tightly against frame 10. Also as can be seen in FIG. 2, bolt 40 passes perpendicularly through the longitudinal axis of support 20 to a part of frame 10 for adjusting support 20 in a horizontal plane. Nuts 42 and 44 are on bolt 40 and, when they are loosened, bolt 40 can be tightened or loosened thus moving support 20 towards or away from that portion of frame 10 in which it is mounted. Thus, to adjust the relative horizontal position of support 20 with respect to platen 12, one first loosens bolts 22 on each end of support 20 and then nuts 42 and 44 on each end are loosened. This allows bolt 40 to be rotated which thus moves support 20 towards or away from platen 12 depending upon which direction the bolt is rotated. Each end of support 20 is separately adjusted and when the support 20 is properly located with respect to platen 12, end bolts 20 are tightened and then nuts 42 and 44 are tightened thus holding the support 20 in the desired location with respect to platen 12.

Figure 3:
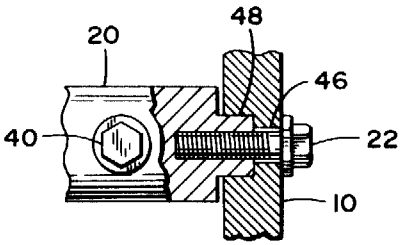
FIG. 3 is a partial cross sectional view of the end portion of the support or shaft which carries the print mechanism illustrating the manner in which it is detachably locked to the printer frame.

FIG. 3 is a partial cross sectional view of one end of support 20 with respect to frame 10. Thus it can be seen in FIG. 3 that one end of support 20 fits in a depression 48 and bolt 22 extends through slot 46 into the threaded orifice in support 20 to pull support 20 tightly against frame 10 when bolt 22 is tightened. However, when bolt 22 is loosened, bolt 40 can be rotated provided that nuts 42 and 44 have been loosened and thus the support 20 will move in a horizontal direction in recess 48 towards or away from platen 12.

Thus it can be seen that a very simple mechanism is used to adjust the relative position of the printing mechanism on the carriage assembly with respect to the platen. Further, it can be seen that with this invention, the adjustment of the position of the printing mechanism in the horizontal plane has no effect whatsoever on the physical adjustment of the platen 12 in the vertical plane by any type of adjustment represented by blocks 13 in FIG. 1. This allows not only a simple mechanism to be used for adjusting the platen in the vertical plane and the position of the print mechanism in the horizontal plane to obtain the proper adjustments, but the mechanism is so simplified that it does not require any great deal of training to understand how the adjustment is to be made. Further it is economical to construct and thus reduces the cost of the printing units.

While the invention has been described in connection with a preferred embodiment, it is not intended to limit the scope of the invention to the particular form set forth but, on the contrary, it is intended to cover such alternatives, modifications and equivalents as may be included in the spirit and scope of the invention as defined by the appended claims.

I claim:

1. Apparatus for adjusting the relative position of a print mechanism to a platen on a printer frame comprising:

a. first and second parallel supports mounted to a printer frame in spaced apart relationship parallel to said platen, b. a pulley support assembly mounted on one of said supports for movement parallel to said supports, c. a bearing assembly slidably mounted on the other of said supports, d. a carriage assembly for carrying a print mechanism thereon, said carriage assembly being mounted to said pulley support assembly and slidably attached to said bearing assembly to allow movement of said print mechanism towards or away from said bearing assembly while maintaining contact with said bearing, e. an elongated cylindrical shaft extending from one side of said frame to the other and forming said one support, f. means for releasably fastening each end of said shaft to said frame, g. a horizontal slot in said frame for receiving each end of said shaft, h. a threaded orifice in each end of said shaft, i. a bolt passing through each slot for mating with each threaded orifice whereby tightening said bolts fastens each end of said shaft to said frame in a corresponding slot, j. a bolt extending horizontally through said shaft in a direction perpendicular to said shaft's longitudinal axis, k. an orifice in said frame for receiving said horizontal shaft bolt, l. a first nut on said horizontal shaft bolt for locking said bolt to said shaft, and m. a second nut on said horizontal shaft bolt for locking said bolt to said frame whereby loosening of said first and second nuts allows said horizontal shaft bolt to be turned thereby moving said shaft in said horizontal slot in a horizontal plane to move said print mechanism toward or away from said platen.

* * * * *